US007501765B2

(12) United States Patent
Curtis et al.

(10) Patent No.: US 7,501,765 B2
(45) Date of Patent: Mar. 10, 2009

(54) EMITTER ELECTRODES FORMED OF CHEMICAL VAPOR DEPOSITION SILICON CARBIDE

(75) Inventors: James R. Curtis, Lansdale, PA (US); John A. Gorczyca, Lansdale, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/956,316

(22) Filed: Oct. 1, 2004

(65) Prior Publication Data

US 2006/0071599 A1 Apr. 6, 2006

(51) Int. Cl.
*H01J 17/04* (2006.01)
*H01J 9/02* (2006.01)
*H01J 1/00* (2006.01)

(52) U.S. Cl. ..... 313/633; 313/310; 313/311

(58) Field of Classification Search ..... 313/633, 313/310–311; 252/516; 250/324–326
See application file for complete search history.

(56) References Cited

U.S. PATENT DOCUMENTS

| | | | | |
|---|---|---|---|---|
| 4,677,638 | A * | 6/1987 | Beaupere et al. | 372/87 |
| 5,008,594 | A * | 4/1991 | Swanson et al. | 315/111.81 |
| 5,447,763 | A * | 9/1995 | Gehlke | 428/34.1 |
| 5,650,203 | A | 7/1997 | Gehlke | 428/34.1 |
| 5,938,823 | A * | 8/1999 | Condit et al. | 96/16 |
| 6,215,248 | B1 | 4/2001 | Noll | 313/633 |
| 6,451,157 | B1 * | 9/2002 | Hubacek | 156/345.17 |
| 7,018,947 | B2 * | 3/2006 | Goela et al. | 501/88 |
| 2002/0127853 | A1 * | 9/2002 | Hubacek et al. | 438/689 |
| 2004/0189176 | A1 * | 9/2004 | Koga et al. | 313/311 |

FOREIGN PATENT DOCUMENTS

| | | |
|---|---|---|
| JP | 63130149 | 6/1988 |
| JP | 3 188699 | 8/1991 |
| JP | 03188699 | 8/1991 |
| JP | 05152054 | 6/1993 |
| JP | 06036857 | 2/1994 |
| JP | 06084581 | 3/1994 |

OTHER PUBLICATIONS

Morgan Advanced Ceramics Website: http://www.performancematerial.com/sic_electrical.htm.*

(Continued)

*Primary Examiner*—Nimeshkumar D. Patel
*Assistant Examiner*—Anne M Hines
(74) *Attorney, Agent, or Firm*—Panitch Schwarze Belisario & Nadel LLP

(57) ABSTRACT

An ionizer emitter electrode is ideally formed of or at least partially coated with a carbide material, wherein the carbide material is selected from the group consisting of germanium carbide, boron carbide, silicon carbide and silicon-germanium carbide. Alternatively, a corona-producing ionizer emitter electrode is substantially formed of silicon carbide. Alternatively, a corona-producing ionizer emitter electrode is formed of an electrically conductive metal base that is at least partially coated with silicon carbide. Alternatively, a corona-producing ionizer emitter electrode ionizes gas when high voltage is applied thereto, and the emitter electrode is formed substantially of silicon carbide and has a resistivity of less than or equal to about one hundred ohms-centimeter (100 Ω-cm).

10 Claims, 2 Drawing Sheets

OTHER PUBLICATIONS

MKS Ion Systems, Technical Note—Ion Systems Emitter Points; Copyright 2006 MKS Instruments, Inc.; downloaded from website: www.mksinst.com/product/ion5.aspx#tech on Apr. 16, 2008, original posting date unknown; 2 pages.

MKS Ion Systems, Technical note—Titanium and Silicon Emitter Point Erosion Analysis; Copyright 1998-2007 MKS Instruments, Inc.; downloaded from website: www.mksinst.com/product/ion5.aspx#tech on Apr. 16, 2008, original posting date unknown; 1 page.

MKS Ion Systems, Air Ionization Theory and Practice; Copyright 2006 Ion Systems, Inc.; downloaded from website: www. mksinst.com/product/ion5.aspx#tech on Apr. 16, 2008, original posting date unknown; 26 pages.

* cited by examiner

EMITTER ELECTRODES FORMED OF CHEMICAL VAPOR DEPOSITION SILICON CARBIDE

BACKGROUND OF THE INVENTION

The present invention is directed to emitter electrodes for gas ionizers and, more specifically, to a gas ionizer emitter electrode formed of or coated with a carbide material such as silicon carbide.

Ion generators are related generally to the field of devices that neutralize static charges in workspaces to minimize the potential for electrostatic discharge. Static elimination is an important activity in the production of technologies such as large scale integrated circuits, magnetoresistive recording heads, and the like. The generation of particulate matter by corona-producing electrodes in static eliminators competes with the equally important need to establish environments that are free from particles and impurities. Metallic impurities can cause fatal damage to such technologies, so it is desirable to suppress those contaminants to the lowest possible level.

It known in the art that when metallic ion emitters are subjected to corona discharges in room air, they show signs of deterioration and/or oxidation within a few hours and the generation of fine particles. This problem is prevalent with needle electrodes formed of copper, stainless steel, aluminum, and titanium. Corrosion is found in areas under the discharge or subjected to the active gaseous species $NO_X$. $NO_3$ ions are found on all the above materials, whether the emitters had positive or negative polarity. Also, ozone-related corrosion is dependent on relative humidity and on the condensation nuclei density. Purging the emitter electrodes with dry air can reduce $NH_4NO_3$ as either an airborne contaminant or deposit on the emitters.

Surface reactions lead to the formation of compounds that change the mechanical structure of the emitters. At the same time, those reactions lead to the generation of particles from the electrodes or contribute to the formation of particles in the gas phase.

Silicon and silicon dioxide emitter electrodes experience significantly lower corrosion than metals in the presence of corona discharges. Silicon is known to undergo thermal oxidation, plasma oxidation, oxidation by ion bombardment and implantation, and similar forms of nitridation. Some have tried to improve silicon emitters by using 99.99% pure silicon that contains a dopant such as phosphorus, boron, antimony and the like. For example, U.S. Pat. No. 5,650,203 (Gehlke) discloses silicon emitters containing a dopant material. However, even such high purity doped silicon emitters suffer from corrosion and degradation.

Another approach is to form emitter electrodes from nearly pure germanium or from germanium with a dopant material. For example, U.S. Pat. No. 6,215,248 (Noll), the contents of which are incorporated by reference herein, discloses germanium needles or emitter electrodes for use in low particle generating gas ionizers and static eliminators. While such germanium emitter electrodes have proven to be less susceptible to corrosion and degradation than metallic emitter electrodes and silicon emitter electrodes with a dopant, there is a need for an emitter electrode that produces or causes even less metallic and/or non-metallic contamination with enhanced resistance to erosion.

BRIEF SUMMARY OF THE INVENTION

Briefly stated, in one embodiment, the present invention comprises an ionizer emitter electrode formed of or coated with a carbide material, wherein the carbide material is selected from the group consisting of germanium carbide, boron carbide, silicon carbide and silicon-germanium carbide. The present invention also comprises a corona-producing ionizer emitter electrode substantially formed of silicon carbide. In another aspect, the present invention is a corona-producing ionizer emitter electrode formed of an electrically conductive metal base, the metal base being coated at least partially with silicon carbide. In yet another aspect, the present invention is a corona-producing ionizer emitter electrode that ionizes gas when high voltage is applied thereto, and the emitter electrode is formed substantially of silicon carbide with the necessary dopant to achieve a resistivity of less than or equal to about one hundred ohms-centimeter (100 Ω-cm).

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention and its applications are not limited to the precise arrangements and instrumentalities shown.

In the drawings.

DETAILED DESCRIPTION OF THE INVENTION

Figure 1:
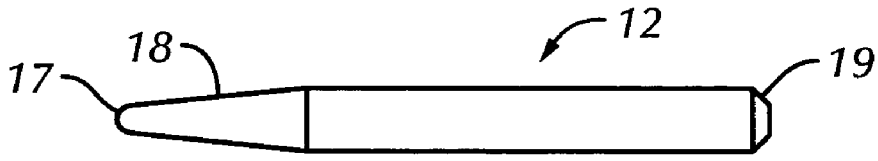
FIG. 1 is a side elevational view of an emitter electrode formed or coated with a carbide material in accordance with some preferred embodiments of the present invention.

Certain terminology is used in the following detailed description for convenience only and is not limiting. The words "right," "left," "lower" and "upper" designate directions in the drawings to which reference is made. The words "inwardly" and "outwardly" refer to directions toward and away from, respectively, the geometric center of the described device and designated parts thereof. The terminology includes the words above specifically mentioned, derivatives thereof and words of similar import. Additionally, the word "a," as used in the claims and in the corresponding portions of the specification means "one" or "at least one."

Referring to the drawings in detail, wherein like numerals represent like elements throughout, there is shown in FIG. 1 an emitter electrode 12 formed or coated with a carbide material, such as silicon carbide (SiC), in accordance with some preferred embodiments of the present invention. The emitter electrode has a generally cylindrically-shaped body and a generally conically-shaped tip 18 ending with a rounded end 17. Alternatively, the rounded end 17 is sharply tapered or pointed. The rear end has a chamfer 19. The shape of the emitter electrode 12 of FIG. 1 is merely exemplary and should not be construed as limiting to this invention. Other shapes, sizes or proportions may be utilized without departing from the present invention.

Pure and ultra-pure SiC has been found, by experimentation, to outlast other electrode materials such as metallic, doped silicon and even pure germanium electrodes. SiC has been found to have superior chemical, plasma and erosion resistance with phenomenal thermal properties as compared to the other mentioned electrode materials. Chemical vapor deposition (CVD) manufacturing produces chemical vapor deposition (CVD) SiC that is highly pure and is commercially available. For example, purities of about 99.9995% CVD SiC can be obtained by CVD manufacturing. Because of the high purity of CVD SiC, the potential for unwanted metallic and non-metallic contamination is drastically reduced and nearly eliminated in gas ionization applications. CVD SiC emitter electrodes 12 also exhibit greater mechanical strength and reduced breakage as compared to similarly designed semiconductive counterparts. Experimentation has demonstrated that SiC, particularly CVD SiC, emitter electrodes are cleaner—with respect to fine particulates—than polycrystalline germanium emitters and single crystal silicon emitter electrodes. Other carbide materials exhibiting physical properties may be utilized such as germanium carbide, boron carbide, silicon carbide, silicon-germanium carbide and the like.

Preferably, the emitter electrode 12 is formed of at least 99.99% pure silicon carbide. Preferably, the silicon carbide is chemical vapor deposition (CVD) silicon carbide. Preferably, the emitter electrode 12 is a corona-producing ionizer emitter electrode 12 that is substantially formed of silicon carbide.

Doping of the carbide material may be necessary to achieve the desired conductivity. For example, in the case of silicon carbide, nitrogen is typically introduced to control the conductivity (resistivity). Preferably, the carbide material is doped to achieve predetermined conductivity characteristics.

Alternatively, the emitter electrode 12 is a corona-producing ionizer emitter electrode 12 formed of an electrically conductive metal base that is at least partially coated with silicon carbide. The metal base may be formed of copper, stainless steel, aluminum, titanium and the like, so long as silicon carbide material coats at least a substantial portion or all of the tip 18. Preferably, silicon carbide material coats all of exposed surfaces of the metal base to reduce the potential for corrosion and degradation.

Figure 3:
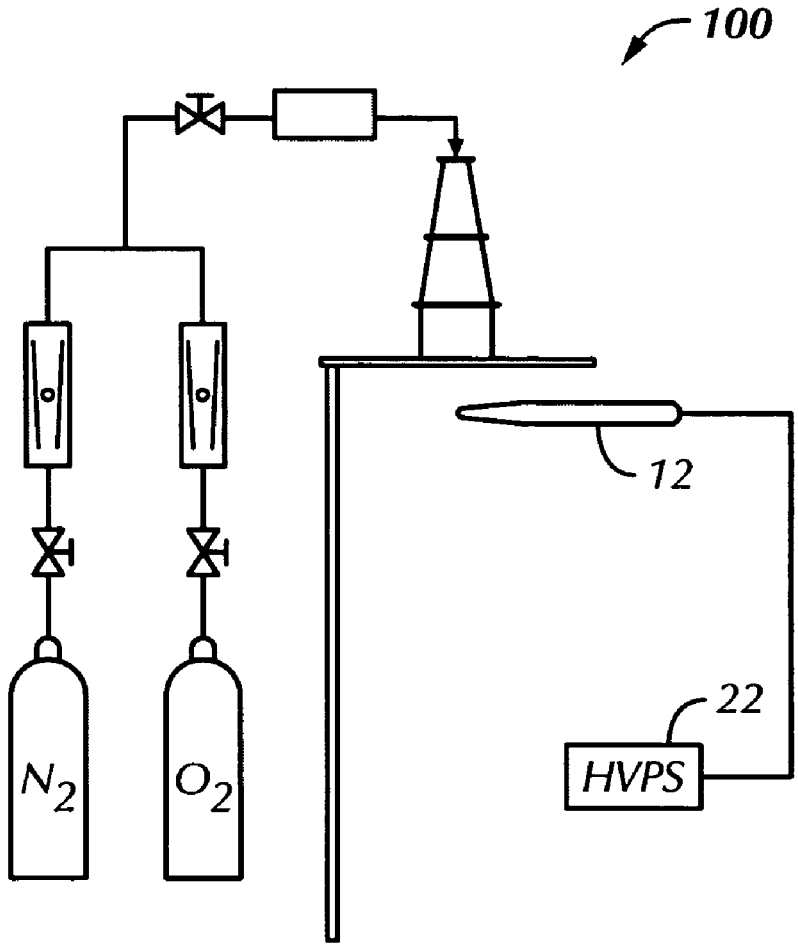
FIG. 3 is a schematic diagram of a gas ionizer which utilizes the preferred embodiments of the present invention.

Referring to FIG. 3, a typical gas ionizer 100 is schematically shown which utilizes the preferred embodiments of the present invention. Gas ionizers 100 typically deliver ionized gas to a clean room, such as a Class 10 clean room or other high cleanliness mini-environment. A high-voltage power supply 22 is electrically coupled to the emitter electrode 12. A corona is produced by application of high voltage to the electrode 12. The gas ionizer 100 may comprise a plurality of emitter electrodes 12 all connected to an AC voltage for generating both positive and negative ions (not shown). Alternatively, the gas ionizer 100 comprises two separately connected sets of electrical emitter electrodes 12 used in conjunction with bipolar DC voltage that allows one set of emitter electrodes 12 to be operated at a positive voltage and a second set of emitter electrodes 12 to be operated at a negative voltage for generating positive and negative ions (not shown).

The high-voltage power supply 22 is typically supplied with electrical power conditioned at between about seventy (70 V) and about two hundred forty (240 V) volts AC at between about fifty (50 Hz) and about sixty (60 Hz) hertz. The high-voltage power supply 22 can include a circuit (not shown in detail), such as a transformer, capable of stepping up the voltage to between about three thousand (3 KV) and ten thousand (10 KV) volts AC at between about fifty (50 Hz) and about sixty (60 Hz) hertz. Alternatively, high-voltage power supply 22 can include a circuit, such as a rectifier that includes a diode and capacitor arrangement, capable of increasing the voltage to between about five thousand (5 KV) and ten thousand (10 KV) volts DC of both positive and negative polarities. Alternatively, the high-voltage power supply 22 is supplied with electrical power conditioned at about twenty-four (24 V) volts DC. The high-voltage power supply 22 can include a circuit, such as a free standing oscillator or switching type arrangement that is used to drive a transformer whose output is rectified, capable of conditioning the voltage to between about three thousand (3 KV) and ten thousand (10 KV) volts DC of both positive and negative polarities. Other power supplies using other voltages may be utilized without departing from the present invention.

Figure 2A:
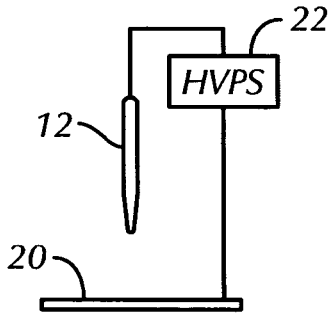
FIG. 2A is a schematic view of a point-to-plane corona producing apparatus in accordance with a first preferred embodiment of the present invention.

FIG. 2A is a schematic view of a point-to-plane corona producing apparatus in accordance with a first preferred embodiment of the present invention. The emitter electrode 12 is arranged in a point geometry and a counter-electrode 20 is arranged in a plane geometry. The power supply 22 is electrically coupled to the emitter electrode 12 to generate a corona. The counter-electrode 20 may be connected to ground (i.e., Earth ground) in the case of high voltage AC or to an opposite polarity of the power supply 22 than the emitter electrode 12 in the case of high-voltage DC.

Figure 2B:
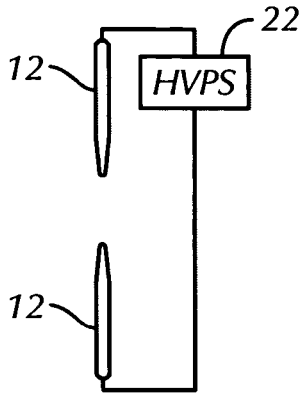
FIG. 2B is a schematic view of a point-to-point corona producing apparatus in accordance with a second preferred embodiment of the present invention.

FIG. 2B is a schematic view of a point-to-point corona producing apparatus in accordance with a second preferred embodiment of the present invention. Two or more emitter electrodes 12 are arranged in a point geometry where the electrodes have opposite voltage polarity. The power supply 22 is electrically coupled to each emitter electrode 12 to generate a corona.

Figure 2C:
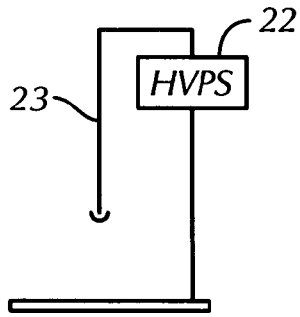
FIG. 2C is a schematic view of a wire-to-plane corona producing apparatus in accordance with a third preferred embodiment of the present invention.

FIG. 2C is a schematic view of a wire-to-plane corona producing apparatus in accordance with a third preferred embodiment of the present invention. A wire electrode 23 formed of SiC is arranged in a thin-wire geometry and a counter-electrode 20 is arranged in a plane geometry. The power supply 22 is electrically coupled to the emitter electrode 12 to generate a corona. The power supply 22 is electrically coupled to the emitter electrode 12 to generate a corona. The counter-electrode 20 may be connected to ground in the case of high voltage AC or to an opposite polarity of the power supply 22 than the emitter electrode 12 in the case of high-voltage DC.

Figure 2D:
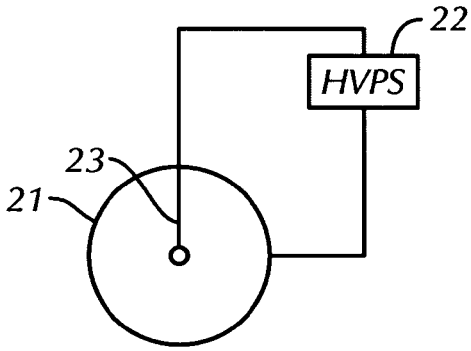
FIG. 2D is a schematic view of a wire to cylinder corona producing apparatus in accordance with a fourth preferred embodiment of the present invention.

FIG. 2D is a schematic view of a wire to cylinder corona producing apparatus in accordance with a fourth preferred embodiment of the present invention. The wire electrode 23 formed of SiC is arranged in a thin-wire geometry and the counter-electrode 21 is arranged in a plane geometry. The power supply 22 is electrically coupled to the emitter electrode 12 to generate a corona. The power supply 22 is electrically coupled to the emitter electrode 12 to generate a corona. The counter-electrode 21 may be connected to ground in the case of high voltage AC or to an opposite polarity of the power supply 22 than the emitter electrode 12 in the case of high-voltage DC.

Figure 2E:
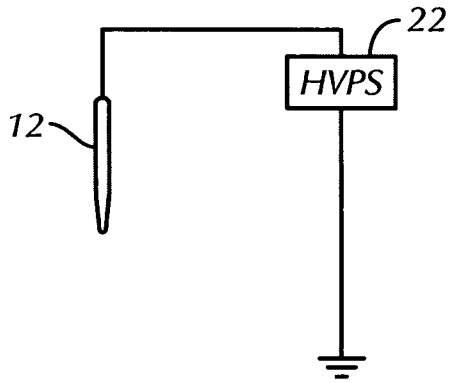
FIG. 2E is a schematic view of a point-to-room corona producing apparatus in accordance with a fifth preferred embodiment of the present invention.

FIG. 2E is a schematic view of a point-to-room corona producing apparatus in accordance with a fifth preferred embodiment of the present invention. The emitter electrode

12 is arranged in a point geometry and there is no counter-electrode 20, 21. The power supply 22 is electrically coupled to the emitter electrode 12 to generate a corona. The power supply 22 is also connected to ground (i.e., Earth ground).

From the foregoing, it can be seen that the present invention comprises an emitter electrode formed or coated with silicon carbide (SiC) or CVD SiC for use with gas ionizers. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A corona-producing ionizer emitter electrode in a gas ionizing static eliminator, the ionizer emitter electrode being formed substantially of at least 99.99% pure chemical vapor deposition (CVD) silicon carbide, the electrode having a generally cylindrically-shaped body and a generally conically-shaped tip.

2. The corona-producing ionizer emitter electrode according to claim 1, wherein the silicon carbide is doped to achieve predetermined conductivity characteristics.

3. The corona-producing ionizer emitter electrode of claim 1, wherein the corona-producing ionizer emitter electrode formed substantially of chemical vapor deposition silicon carbide has a purity of about 99.990% to 99.999%.

4. A corona-producing ionizer emitter electrode in a gas ionizing static eliminator, the ionizer emitter electrode ionizing gas when high voltage is applied thereto, the emitter electrode being formed substantially of at least 99.99% pure chemical vapor deposition (CVD) silicon carbide, the electrode having a generally cylindrically-shaped body and a generally conically-shaped tip, and having a resistivity of less than or equal to about one hundred ohms-centimeter (100 Ω-cm).

5. The corona-producing ionizer emitter electrode of claim 4, wherein the corona-producing ionizer emitter electrode has a resistivity of about one hundred ohms-centimeter.

6. A corona-producing ionizer emitter electrode in a gas ionizing static eliminator, formed substantially of at least 99.99% pure chemical vapor deposition (CVD) silicon carbide, comprising:

a high voltage;

a resistivity of less than or equal to about one hundred ohms-centimeter (100 Ω-cm); and wherein the emitter electrode has a generally cylindrically-shaped body and a generally conically-shaped tip.

7. The corona-producing ionizer emitter electrode in a gas ionizing static eliminator of claim 6, wherein the high voltage is about 70 to about 240 volts AC.

8. The corona-producing ionizer emitter electrode in a gas ionizing static eliminator of claim 6, wherein the high voltage is about 3,000 to about 10,000 volts AC.

9. A gas ionizer comprising:

at least one corona electrode formed substantially of chemical vapor deposition silicon carbide; and a power supply electrically coupled to the electrode, wherein the power supply provides an AC voltage of about 3,000 to about 10,000 volts.

10. The gas ionizer of claim 9, wherein the at least one corona electrode formed substantially of chemical vapor deposition silicon carbide has a purity of about 99.990% to 99.999%.

* * * * *